United States Patent [19]

Peterson et al.

[11] 4,212,375

[45] Jul. 15, 1980

[54] ALIGNING APPARATUS FOR MATERIAL HANDLING SYSTEM

[75] Inventors: Laurel L. Peterson, East Peoria; Alan J. Hickman, Peoria, both of Ill.

[73] Assignee: Caterpillar Tractor Co., Peoria, Ill.

[21] Appl. No.: 915,694

[22] Filed: Jun. 15, 1978

[51] Int. Cl.[2] ..... B66B 9/20

[52] U.S. Cl. ..... 187/9 R; 414/275

[58] Field of Search ..... 187/9 R, 1 R; 414/222, 414/234, 249, 275, 273, 349

[56] References Cited

U.S. PATENT DOCUMENTS

| | | | |
|---|---|---|---|
| 3,268,097 | 8/1966 | Armington, Jr. et al. | 414/273 |
| 3,486,640 | 12/1969 | Lemelson | 214/16.4 R |
| 3,672,470 | 6/1972 | Ohntruf et al. | 187/1 |
| 3,818,302 | 6/1974 | Rutledge | 318/467 |

*Primary Examiner*—Kenneth W. Noland

*Attorney, Agent, or Firm*—William B. Heming

[57] ABSTRACT

A material handling system (10) has a lifting element (12) and first apparatus (14) for moving the lifting element (12). The system (10) is, for example, a work vehicle having mast mounted implements, such as a lift truck (10) with forks (12) or a container handler. Proper alignment of the lifting element (12) relative to material (46) to be loaded and structure (52) adjacent the material (46) is necessary to engage the material (46). The material handling system (10) has a second apparatus (40) for delivering first and second signals in response to first and second surfaces (20,22) of the lifting element (12) being at elevations (42,48) greater and lesser than first and second preselected elevations (44,50), respectively. A third apparatus (57) automatically moves one of the lifting element surfaces (20,22) to the respective one of the preselected elevations (44,50), in response to receiving a respective one of the signals for automatically aligning the lifting element (12).

12 Claims, 3 Drawing Figures

46
52
50
44
48
56
54
40
62
64
42
16
18
22
20
10
12

ALIGNING APPARATUS FOR MATERIAL HANDLING SYSTEM

TECHNICAL FIELD

The invention relates to a material handling system having a lifting element positionable for engaging and moving material, such as a lift truck having a fork. More particularly, the invention relates to means for automatically positioning the lifting element relative to the material and an adjacent structure in order to properly align the lifting element during engagement of the material.

BACKGROUND ART

In the use of a material handling system, it is desirable to provide means for automatically aligning a lifting element relative to material to be handled in order to substantially overcome problems associated with incorrect engagement of the lifting element and the material.

For example, a work vehicle, such as a lift truck, commonly has forks used to engage and lift material to be moved to another location. The lift truck has a manually operated valve to control the vertical movement of the forks. The operator of the lift truck adjusts the elevation of the forks in order to engage the material.

The material is frequently positioned on a pallet for convenient movement and storage. Proper alignment of the forks within the pallet opening is necessary to engage the load. The operator can sometimes misjudge the elevation of the forks and improperly engage the material. The result is damage to or tipping of the material from the pallet or movement of the pallet relative to the lift truck preventing engagement. This represents a waste of time and labor.

In automated material handling, the shuttle mechanisms used to retrieve and store materials generally require large operating clearances of the forks relative to pallet openings than is normally available. This can sometimes prevent use of the automated system with pallets and represents another waste of time and labor.

Therefore, it is desirable to provide means for delivering signals in response to preselected positions of the lifting element relative to the material to be loaded and adjacent structure and means for automatically moving the lifting element in response to receiving said signals for properly aligning the lifting element.

SUMMARY OF THE INVENTION

In one aspect of the invention, a material handling system has a lifting element and first means for controllably moving the lifting element between first and second positions. The lifting element has first and second surfaces. Second means is provided for delivering first and second signals. The first signal is delivered in response to the first surface of the lifting element being at an elevation greater than a first preselected elevation relative to material to be loaded on said first surface. The second signal is delivered in response to said second surface of the lifting element being at an elevation less than a second preselected elevation relative to structure adjacent said material to be loaded on said first surface. Third means is provided for receiving said first and second signals and automatically moving one of said lifting element surfaces to the respective one of said preselected elevations in response to receiving a respective one of said signals.

The lifting element on forks of a lift truck, for example, must be properly aligned relative to the opening on a pallet to properly engage the load. The second means delivers respective signals in response to one of the surfaces of the lifting element being improperly aligned. The third means automatically moves the lifting element for adjustment to provide proper alignment relative to the opening of the pallet.

BEST MODE FOR CARRYING OUT THE INVENTION

Figure 1:
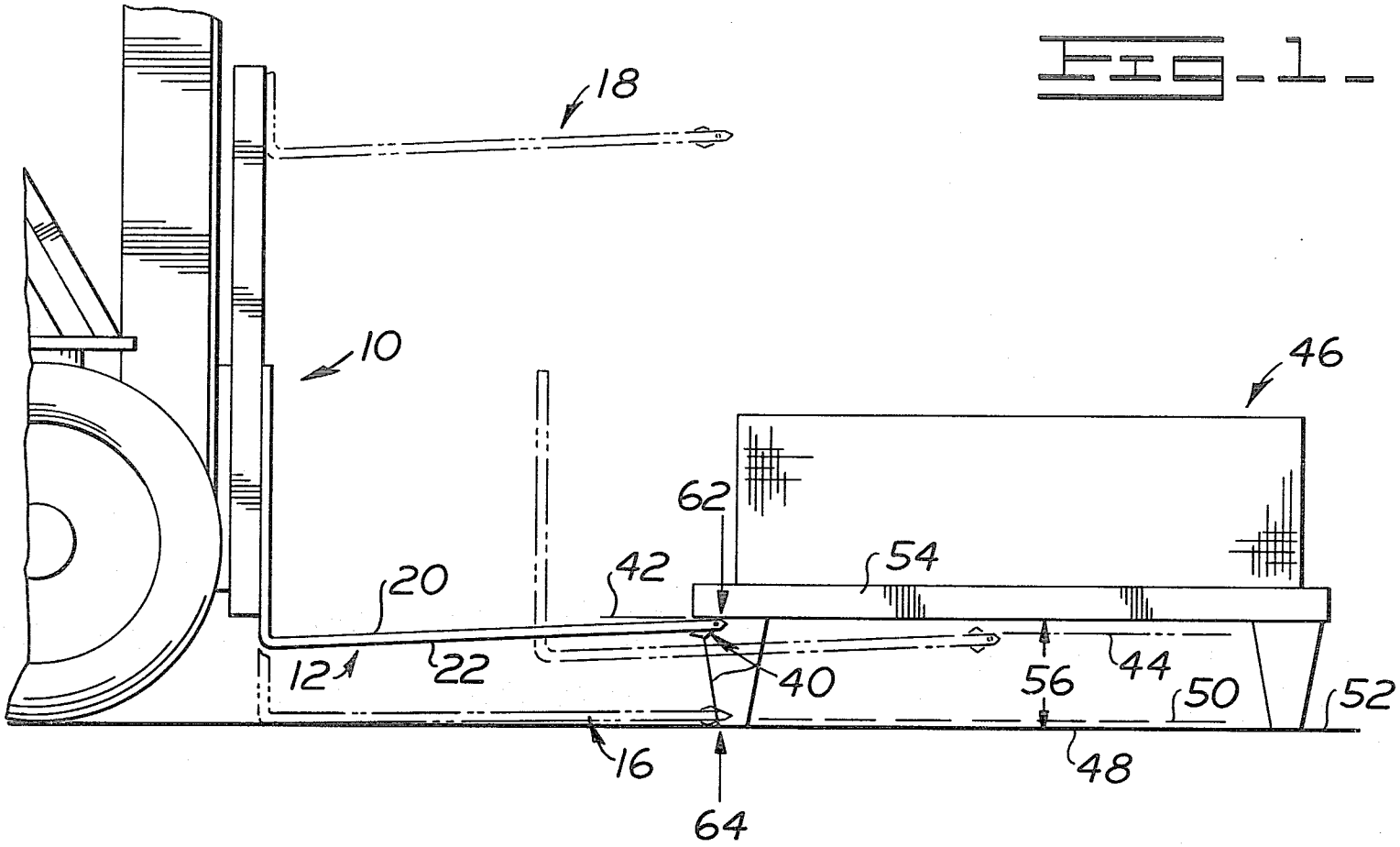
FIG. 1 is a diagrammatic view showing an embodiment of the invention on a lift truck.
Figure 2:
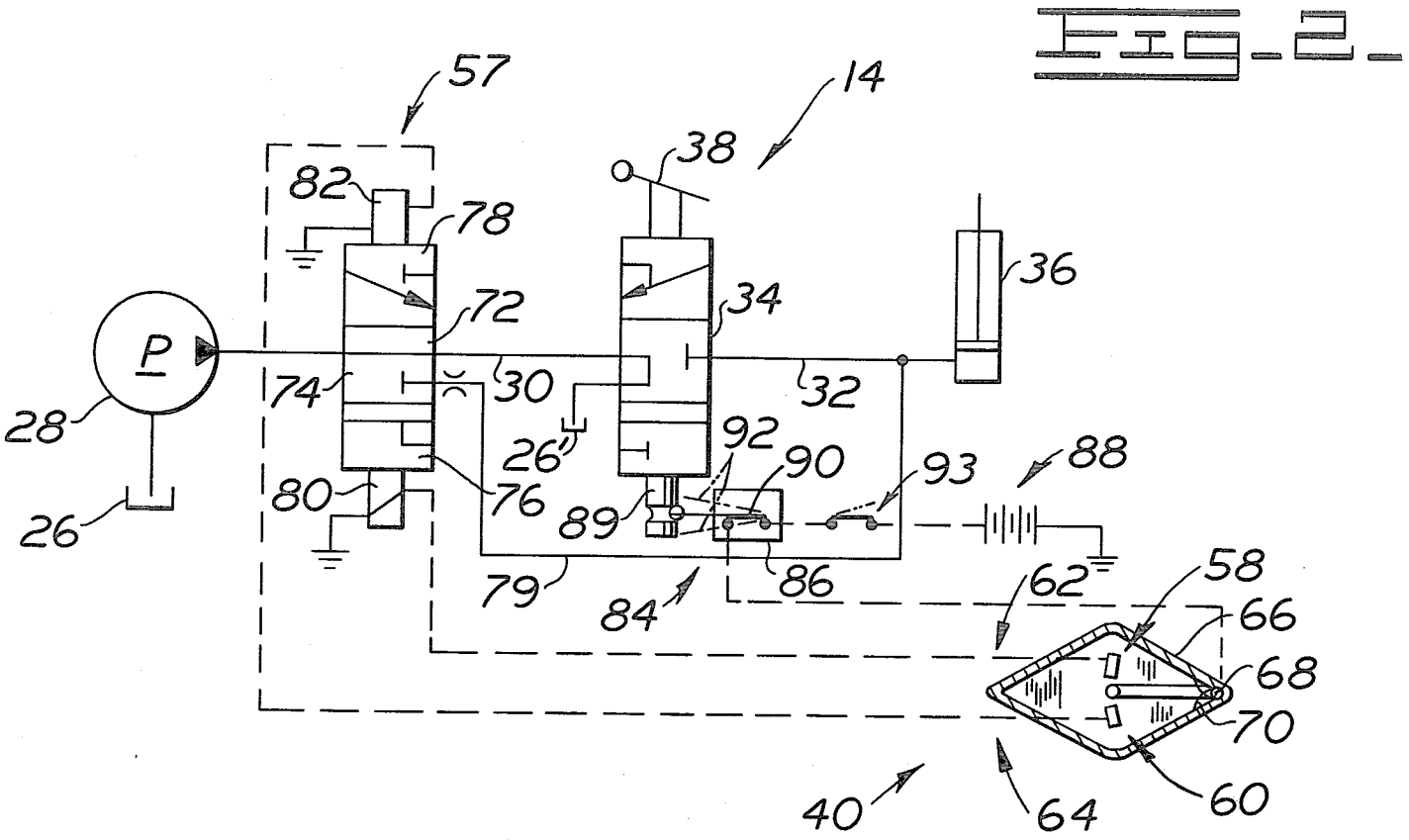
FIG. 2 is a diagrammatic view showing an embodiment of the invention in greater detail.
Figure 3:
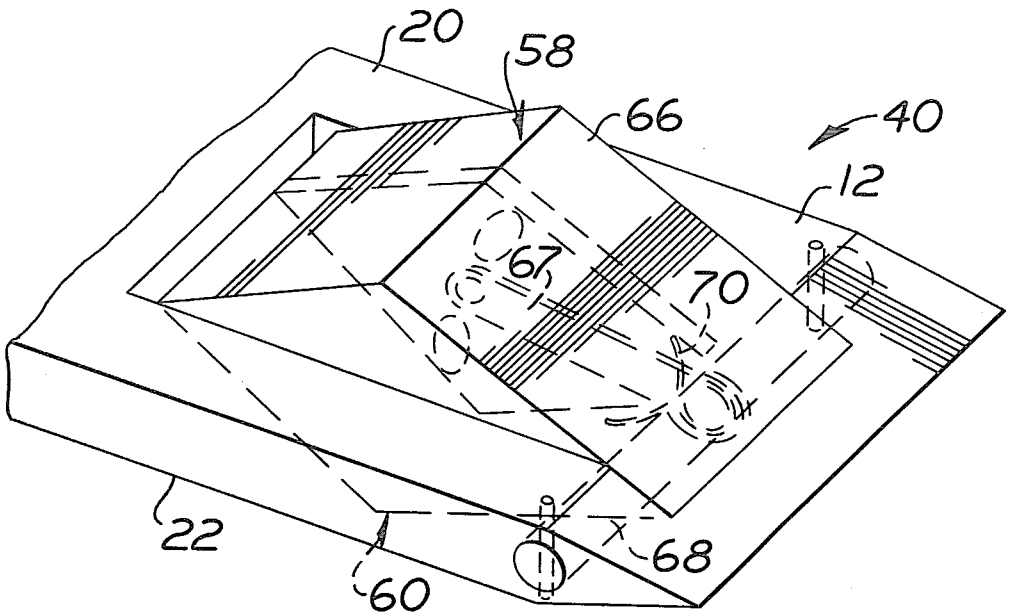
FIG. 3 is a diagrammatic view showing an embodiment of the invention in still greater detail.

Referring to the drawings, a material lifting system 10 has a lifting element 12 and first means 14 for controllably moving the lifting element 12 between first and second positions 16,18. Said first and second positions 16,18 are at the lowest and highest elevations of the lifting element 12, respectively. Said lifting element 12 has first and second surfaces 20,22.

The material lifting system 10 is shown as a lift truck 10. The lift truck 10 has forks or lifting element 12. The forks 12 each have a portion of said first and second surfaces 20,22.

As is well known in the art, the first means 14 of the lift truck 10 is commonly a hydraulic circuit 14. The hydraulic circuit 14 has a tank 26,26', a pressurized fluid source or pump 28 providing a fluid flow, first and second hydraulic lines 30,32, lift control valve 34, and a single acting hydraulic cylinder 36. The forks 12 are controlled by moving a control handle 38 to control said valve 34.

Second means 40 is provided for delivering first and second signals. The first signal is delivered in response to the first surface 20 of the lifting element 12 being at an elevation 42 greater than a first preselected elevation 44 relative to material 46 to be loaded on said first surface 20. The second signal is delivered in response to said second surface 22 of the lifting element 12 being at an elevation 48 lesser than a second preselected elevation 50 relative to structure 52 adjacent said material 46 to be loaded on the first surface 20.

The material to be loaded includes a pallet 54. The structure 52 adjacent the material 46 is shown as ground 52. The first and second preselected elevations 44,50 are shown relative to a pallet 54 and the ground 52, respectively. The pallet 54 and ground 52 define an opening 56.

Third means 57 is provided for receiving the first and second signals and automatically moving one of said surfaces 20,22 of the lifting element 12 toward the respective one of the preselected elevations 44,50 in response to receiving a respective one of the signals.

Preferably, the second means 40 includes first and second switch portions 58,60 connected to the lifting element 12. The first switch portion 58 extends above the first surface 20. The second switch portion 60 extends below the second surface 22. It is desirable that said first and second switch portions 58,60 be of a construction sufficient for delivering a respective one of the first and second signals in response to being forcibly urged in respective first and second preselected directions 62,64.

As is shown, the switch portions 58,60 are mounted on the end portion of the lifting element 12. Said first and second switch portions 58,60 are connected relative to the first and second surfaces 20,22, respectively.

The switch portions 58,60 include a common annular member or housing 66. A terminal arm 67 is positioned in the housing 66. A pin 68 pivotally connects the housing 66 to the lifting element 12. Biasing means 70, shown as a torsional spring 70, maintains the housing 66 in a position centered relative to the first and second surfaces 20,22 of the lifting element 12. Each of the forks 12 preferably has a respective pair of first and second switch portions 58,60. It should be understood that the switch 58,60 can be of different configurations and located in different positions without departing from the invention.

Third means 57 includes a controlling valve 72 movable between first, second, and third positions 74,76, 78. At the first position 74, fluid from the third means is blocked from passing in a direction sufficient for moving the lifting element 12. At the second position 76, the fluid is passed in a direction sufficient for moving the first surface 20 of the lifting element 12 toward the first preselected elevation 44. At the third position 78, fluid is passed in a direction sufficient for moving the second surface 22 of the lifting element 12 toward the second preselected elevation 50. Said valve 72 is connected to the first line 30 between the pump 28 and lift control valve 34. A third hydraulic line 79 connects said valve 72 to the cylinder 36.

The controlling valve 72 preferably has first and second solenoids 80,82 each connected to a respective one of the first and second switch portions 58,60. The first and second solenoids 80,82 are connected to the first and second switch portions 58,60 and associated with the second and third positions 76,78 of the controlling valve 72, respectively.

It is desirable that the material lifting system 10 include fourth means 84 for blocking the second means 40 from delivering the first and second signals. The fourth means 84 includes a switch 86. A power means 88, shown as a battery 88 of the lift truck 10, is connected to the second means 40 at the terminal arm 67. The switch 86 is associated with the first means 14 and connected between the power means 88 and the second means 40. Said switch 86 is shown connected to a flange 89. The flange 89 moves with and in response to movement of the lift control valve 34.

The switch 86 is movable between a first position 90 at which the circuit between the power means 88 and second means 40 is closed and a second position 92 (shown in outline) at which the circuit between the power means 88 and second means 40 is closed.

The third and fourth means 57,84 can be of other construction as is well known in the arts without departing from the invention. For example, the third means can include control elements using electric motors.

INDUSTRIAL APPLICABILITY

In the use of the material lifting system 10, the lifting element 12 is automatically moved for aligning the lifting element 12 relative to the material 46 to be loaded and the structure 52 adjacent the material 46 to substantially overcome the problems associated with improper engagement of the lifting element 12 and the material 46.

The first preselected elevation 44 is dependent upon the position and attitude of the first surface 20 of the lifting element 12 relative to the pallet 54 for proper engagement of the material 46. Said lifting element 12 is moved within the opening 56 with clearance between said pallet 54 and the first surface 20 of the fork 12. The second preselected elevation 50 is similarly dependent upon the position and attitude of the second surface 22 of the lifting element 12 relative to the ground 52.

For example, in order to engage and move the material 46, the operator of the lift truck 10 moves the control handle 38 to position the forks 12 relative to the pallet 54 and ground 52. If the forks 12 are not properly positioned, said forks 12 contact the pallet 54 or ground 52. The operator must normally reposition said forks 12 in order to engage the pallet 54. According to the present invention, the forks 12 automatically move into proper alignment with the pallet 54 and ground 52.

When the first surface 20 of the forks 12 is at an elevation 42 greater than the first preselected elevation 44, the forks 12 contact the pallet 54 (FIG. 1). The housing 66 also contacts the pallet 54 and is forcibly urged in the first preselected direction 62. Movement of the housing 66 forcibly urges the first switch portion 58 in the first preselected direction 62 and into contact with the terminal arm 67. The result is to complete the circuit from the power means 88 to the first solenoid 80, sending the first signal to said first solenoid 80.

The solenoid 80 shifts the controlling valve 72 to the second position 76. Fluid passing from the pump 28 through the first line 30 is dumped to the tank 26'. The third hydraulic line 79 is also open to the tank 26'. Fluid in the hydraulic cylinder 36 is dumped into said tank 26' owing to the force gravity on the forks 12 and the forcible contact of the first surface 20 of the forks 12 against the pallet 54. In this manner, the first surface 20 is lowered to substantially the first preselected elevation 44. The spring 70 returns the housing 66 to a position centered with respect to the first and second surfaces 20,22 (FIG. 1), removing the first switch portion 58 from contact with the terminal arm 67 and interrupting the first signal. The forks 12 are then inserted into position substantially within the opening 56 by the operator.

Similarly, contact of the housing 66 and ground 52 forcibly urges the second switch portion 60 in the second preselected direction 64 and into contact with the terminal arm 67. The second solenoid 82 receives the second signal and shifts the controlling valve 72 to the third position 78. Fluid passing from the pump 28 through the first line 30 is passed through the third hydraulic line 79 and into the hydraulic cylinder 36. The cylinder 36 expands and the forks 12 are raised to a position at which the second surface 22 is substantially at the second preselected elevation 50.

Once the forks 12 have been properly positioned, the operator moves the control handle 38 to operate the lift control valve 34. This raises the forks 12 toward the second position 18. Normally, the resulting contact of the forks 12 and pallet 54 would cause the first switch portion 58 to signal the controlling valve 72. However, the flange 89 moves with the lift control valve 34, causing the switch 86 to be actuated from the normally closed first position 90 to the open second position 92. In the open second position 92, the circuit between the power means 88 and switch portions 58,60 is interrupted and the first switch portion 58 is blocked from signalling the controlling valve 72 to prevent the automatic movement of the forks 12.

In the above-mentioned manner, the lifting element or forks 12 are automatically moved relative to the pallet 54 and ground 52 for adjusting said forks 12 and providing proper engagement of the material 46 to be loaded. Similarly, the invention automatically aligns said forks 12 relative to material or a pallet stored in stacks or on storage racks. A cutoff switch 93 is positioned between the battery 88 and switch portions 58,60 to neutralize said switch portions 58,60 and prevent automatic alignment of the forks 12 when desired.

Other aspects, objects and advantages of this invention can be obtained from a study of the drawings, the disclosure and the appended claims.

What is claimed is:

1. In a material lifting system (10) having a lifting element (12) and first means (14) for controllably moving the lifting element (12) between first and second positions (16,18), said lifting element (12) having first and second surfaces (20,22) and being positionable between material (46) to be loaded on said first surface (20) and structure (52) adjacent said material (46) to be loaded on said first surface (46), the improvement comprising:

second means (40) for delivering a first signal in response to said first surface (20) of the lifting element (12) being at an elevation (42) greater than a first preselected elevation (44) relative to said material (46) to be loaded on said first surface (20) and a second signal in response to said second surface (22) of the lifting element (12) being at an elevation (48) less than a second preselected elevation (50) relative to said structure (52) adjacent said material (46) to be loaded on said first surface (20), said second means (40) including first and second switch portions (58,60) connected to said lifting element (12), said first switch portion (58) extending above said first surface (20) and being contactable with said material (46) to be loaded in response to said first surface (20) being positioned between said material (46) and adjacent structure (52) and at said elevation (42) greater than said first preselected elevation (44), said second switch portion (60) extending below said second surface (22) and being contactable with said adjacent structure (52) in response to said second surface (22) being positioned between said material (46) and adjacent structure (52) and at said elevation (48) less than said second preselected elevation (50); and third means (57) for receiving said first and second signals and automatically positioning one of said surfaces (20,22) of the lifting element (12) at the respective related one of said preselected elevations (44,50) in response to receiving the related respective one of said signals.

2. The improvement, as set forth in claim 1, wherein the lifting element (12) is lift truck forks (12) and the first means (14) is a hydraulic circuit (14).

3. The improvement, as set forth in claim 1, wherein said first and second switch portions (58,60) are each of a construction sufficient for delivering a respective one of the first and second signals in response to being forcibly urged in respective first and second preselected directions (62,64).

4. The improvement, as set forth in claim 1, wherein the third means (57) includes a controlling valve (72) movable between a first position (74) at which fluid is blocked from passing in a direction sufficient for moving the lifting element (12), a second position (76) at which fluid is passed in a direction sufficient for moving the first surface (20) of the lifting element (12) toward the first preselected elevation (44) and a third position (78) at which fluid is passed in a direction sufficient for moving the second surface (22) of the lifting element (12) toward the second preselected elevation (50).

5. The improvement, as set forth in claim 4, wherein the controlling valve (72) has first and second solenoids (80,82) each connected to a respective one of the first and second switch portions (58,60).

6. The improvement, as set forth in claim 1, wherein the material lifting system (10) includes fourth means (84) for blocking the second means (40) from delivering the first and second signals.

7. The improvement, as set forth in claim 6, wherein said fourth means (84) includes a switch (86).

8. The improvement, as set forth in claim 7, including power means (88) connected to the second means (40) and wherein said switch (86) is associated with the first means (14) and connected between the power means (88) and the second means (40), said switch (86) being movable between a first position (90) at which the circuit between power means (88) and second means (40) is closed and a second position (92) at which the circuit between the power means (88) and second means (40) is open.

9. In a material lifting system (10) having a lifting element (12) and first means (14) for controllably moving the lifting element (12) between first and second positions (16,18), said lifting element (12) having first and second surfaces (20,22) and being positionable between material (46) to be loaded on said first surface (20) and structure (52) adjacent said material (46) to be loaded on said first surface (20), the improvement comprising:

first and second switch portions (58,60) connected to said lifting element (12) and being of a configuration sufficient for delivering first and second signals, respectively, in response to being urged in first and second directions (62,64), respectively, said first switch portion (58) extending above said first surface (20) and being urged in said first direction (62) in response to said first surface (20) being positioned between said material (46) and adjacent structure (52) and at an elevation (42) greater than a first preselected elevation (44) relative to said material (46), said second switch portion (60) extending below said second surface (22) and being urged in said second direction (64) in response to said second surface (22) being positioned between said material (46) and said adjacent structure (52) and at an elevation (48) less than a second preselected elevation (50) relative to said adjacent structure (52); and third means (57) for receiving said first and second signals and automatically positioning one of said surfaces (20,22) of the lifting element (12) at the respective related one of said preselected elevations (44,50) in response to receiving the related respective one of said signals.

10. The improvement, as set forth in claim 9, wherein said first and second switch portions (58,60) have a common housing (66), said housing (66) being contactable with said material (46) to be loaded and said adjacent structure (52) and being of a configuration sufficient for urging said first and second switch portions (58,60) in the respective one of the first and second directions (62,64) in response to contacting said material (46) and adjacent structure (52), respectively.

11. The improvement, as set forth in claim 9, wherein said third means (57) includes a controlling valve (72) associated with said first and second switch portions (58,60) and said first means (14) and being movable between first, second and third positions (74,76,78) in response to receiving said first and second signals, said first surface (20) of said lifting element (12) is automatically moved toward said first preselected elevation (44) at said second position (76) and said second surface (22) of said lifting element (12) is automatically moved toward said second preselected elevation (50) at said third position (78).

12. The improvement, as set forth in claim 9, wherein said lifting element (12) is a lift truck fork (12) having an end portion and said first and second switch portions (58,60) are mounted on said end portion of the lift fork (12).

* * * * *